US009027667B2

(12) United States Patent
Zhang et al.

(10) Patent No.: US 9,027,667 B2
(45) **Date of Patent: *May 12, 2015**

(54) STRUCTURE FOR GUNPOWDER CHARGE IN COMBINED FRACTURING PERFORATION DEVICE

(71) Applicant: Tong Oil Tools Co., Ltd., Xi'an (CN)

(72) Inventors: Guoan Zhang, Xi'an (CN); Jianlong Cheng, Xi'an (CN); Xianhong Sun, Xi'an (CN)

(73) Assignee: Tong Oil Tools Co. Ltd., Xi'an (CN)

( * ) Notice: Subject to any disclaimer, the term of this patent is extended or adjusted under 35 U.S.C. 154(b) by 45 days.

This patent is subject to a terminal disclaimer.

(21) Appl. No.: 13/759,064

(22) Filed: Feb. 5, 2013

(65) Prior Publication Data

US 2013/0145924 A1 Jun. 13, 2013

Related U.S. Application Data

(63) Continuation-in-part of application No. PCT/CN2011/083112, filed on Nov. 29, 2011, and a continuation-in-part of application No. 13/521,522, filed as application No. PCT/CN2010/078601 on Nov. 10, 2010.

(30) Foreign Application Priority Data

Dec. 29, 2010 (CN) ..... 2010 2 0684805

(51) Int. Cl.
*E21B 43/116* (2006.01)
*E21B 43/119* (2006.01)

(52) U.S. Cl.
CPC ..... *E21B 43/119* (2013.01)

(58) Field of Classification Search
USPC ..... 175/4.5, 4.6; 89/1.15
See application file for complete search history.

(56) References Cited

U.S. PATENT DOCUMENTS 2,837,995 A 6/1958 Castel
2,980,017 A 4/1961 Castel (Continued)

FOREIGN PATENT DOCUMENTS

CN 2270115 12/1997
CN 2309419 3/1999

(Continued)

OTHER PUBLICATIONS

Sep. 15, 2011 Office Action for CN 200910218911.0.

(Continued)

*Primary Examiner* — William P Neuder
(74) *Attorney, Agent, or Firm* — Law Offices of Albert Wai-Kit Chan, PLLC

(57) ABSTRACT

This invention provides a structure for gunpowder charge for charging gunpowders of different rates in combined fracturing perforation devices. The structure for gunpowder charge is convenient to mount and transport. In one embodiment, said structure for gunpowder charge comprises an inner gunpowder box located between adjacent perforating charges in the charge frame of a perforation device, and an outer gunpowder box attached to the outer wall of the charge frame, wherein said outer gunpowder box comprises one or two box units (2 or 4) with at least one claw at the inner side of said box unit, said claw can be locked into a groove or installation hole of the charge frame, and wherein said inner gunpowder box and said outer gunpowder box are charged with gunpowders of different burning rates.

18 Claims, 8 Drawing Sheets

(56) References Cited

U.S. PATENT DOCUMENTS

| | | | |
|---|---|---|---|
| 3,620,314 | A | 11/1971 | Bohn |
| 4,191,265 | A | 3/1980 | Bosse-Platiere |
| 4,253,523 | A | 3/1981 | Ibsen |
| 4,627,353 | A | 12/1986 | Chawla |
| 4,633,951 | A | 1/1987 | Hill et al. |
| 4,683,943 | A | 8/1987 | Hill et al. |
| 4,760,883 | A | 8/1988 | Dunn |
| 4,823,875 | A | 4/1989 | Hill |
| 4,976,318 | A | 12/1990 | Mohaupt |
| 5,355,802 | A | 10/1994 | Petitjean |
| 5,775,426 | A | 7/1998 | Snider et al. |
| 5,885,321 | A | 3/1999 | Higa et al. |
| 6,082,450 | A | 7/2000 | Snider et al. |
| 6,186,230 | B1 | 2/2001 | Nierode |
| 6,439,121 | B1 | 8/2002 | Gillingham |
| 6,497,285 | B2 | 12/2002 | Walker |
| 6,837,310 | B2 | 1/2005 | Martin |
| 6,851,471 | B2 | 2/2005 | Barlow et al. |
| 7,216,708 | B1 | 5/2007 | Bond et al. |
| 7,430,965 | B2 | 10/2008 | Walker |
| 7,913,761 | B2 | 3/2011 | Pratt et al. |
| 2002/0134585 | A1 | 9/2002 | Walker |
| 2002/0189802 | A1 | 12/2002 | Tolman et al. |
| 2003/0037692 | A1 | 2/2003 | Liu |
| 2003/0150646 | A1 | 8/2003 | Brooks et al. |
| 2004/0129415 | A1 | 7/2004 | Xi et al. |
| 2004/0216866 | A1 | 11/2004 | Barlow et al. |
| 2005/0115441 | A1 | 6/2005 | Mauldin |
| 2005/0139352 | A1 | 6/2005 | Mauldin |
| 2006/0118303 | A1 | 6/2006 | Schultz et al. |
| 2009/0078420 | A1 | 3/2009 | Caminari et al. |
| 2009/0183916 | A1 | 7/2009 | Pratt et al. |
| 2010/0258292 | A1 | 10/2010 | Tiernan et al. |
| 2010/0276136 | A1 | 11/2010 | Evans et al. |
| 2011/0240311 | A1 | 10/2011 | Robison et al. |
| 2013/0098681 | A1 | 4/2013 | Zhang et al. |
| 2013/0145924 | A1 | 6/2013 | Zhang et al. |
| 2013/0146287 | A1 | 6/2013 | Zhang et al. |
| 2013/0206385 | A1 | 8/2013 | Feng et al. |

FOREIGN PATENT DOCUMENTS

| | | | |
|---|---|---|---|
| CN | 2314091 | | 4/1999 |
| CN | 2348095 | | 11/1999 |
| CN | 2376535 | | 5/2000 |
| CN | 2386194 | | 7/2000 |
| CN | 2391987 | | 8/2000 |
| CN | 2437852 | | 7/2001 |
| CN | 1312882 | | 9/2001 |
| CN | 2453132 | | 10/2001 |
| CN | 2485421 | | 4/2002 |
| CN | 2555393 | | 6/2003 |
| CN | 1143944 | | 3/2004 |
| CN | 2611593 | | 4/2004 |
| CN | 2628724 | | 7/2004 |
| CN | 2630491 | | 8/2004 |
| CN | 2630493 | | 8/2004 |
| CN | 2653125 | | 11/2004 |
| CN | 2682199 | | 3/2005 |
| CN | 2695631 | | 4/2005 |
| CN | 2818773 | | 9/2006 |
| CN | 2818774 | | 9/2006 |
| CN | 2821154 | | 9/2006 |
| CN | 2821154 | Y | 9/2006 |
| CN | 2846740 | | 12/2006 |
| CN | 2854071 | | 1/2007 |
| CN | 1916357 | | 2/2007 |
| CN | 2866810 | | 2/2007 |
| CN | 200968200 | | 10/2007 |
| CN | 201045293 | | 4/2008 |
| CN | 100491692 | | 5/2009 |
| CN | 201358768 | | 12/2009 |
| CN | 201396090 | | 2/2010 |
| CN | 201412133 | | 2/2010 |
| CN | 1916357 | A | 6/2010 |
| CN | 201531256 | | 7/2010 |
| CN | 201568033 | | 9/2010 |
| CN | 201568038 | | 9/2010 |
| CN | 201620848 | | 11/2010 |
| CN | 101952542 | | 1/2011 |
| CN | 102031952 | | 4/2011 |
| CN | 201843593 | | 5/2011 |
| CN | 102094613 | | 6/2011 |
| CN | 201865649 | | 6/2011 |
| CN | 201884014 | | 6/2011 |
| CN | 201934084 | | 8/2011 |
| CN | 201934084 | U | 8/2011 |
| CN | 201934086 | | 8/2011 |
| CN | 201991504 | | 9/2011 |
| CN | 202055812 | | 11/2011 |
| CN | 102410006 | | 4/2012 |
| CN | 102518419 | | 6/2012 |
| CN | 1690357 | | 7/2012 |
| CN | 202391399 | | 8/2012 |
| CN | 102011561 | | 4/2013 |
| CN | 102052068 | | 4/2013 |
| CN | 102022101 | | 7/2013 |
| WO | 02/063133 | | 8/2002 |
| WO | 2011057564 | | 5/2011 |
| WO | 2011057564 | A1 | 5/2011 |
| WO | 2012088985 | | 5/2011 |
| WO | WO 2011/057564 | * | 5/2011 |
| WO | 2012088984 | | 7/2012 |
| WO | 2013090647 | | 6/2013 |
| WO | 2013123268 | | 8/2013 |
| WO | 2013130166 | | 9/2013 |

OTHER PUBLICATIONS

Mar. 5, 2012 Office Action for CN 200910218911.0.
Jul. 6, 2013 2nd Office Action for CN 201010609790.5.
Jul. 11, 2013 1st Office Action for CN 201110426049.X.
Feb. 10, 2011 International Search Report for PCT/CN2010/078601.
Mar. 15, 2012 International Search Report for PCT/CN2011/083112.
Mar. 8, 2013 International Search Report for PCT/CN2011/083113.
Aug. 6, 2013 International Search Report for PCT/US2012/069606.
Feb. 28, 2013 International Search Report for PCT/US2012/069607.
Feb. 10, 2011 Written Opinion for PCT/CN2010/078601.
Mar. 15, 2012 Written Opinion for PCT/CN2011/083112.
Mar. 8, 2013 Written Opinion for PCT/CN2011/083113.
Aug. 6, 2013 Written Opinion for PCT/US2012/069606.
Feb. 28, 2013 Written Opinion for PCT/US2012/069607.
Zhang, 2009, "Mechanism Difference and Safety Analysis of Different Composite Perforators Types", Testing of Oil and Gas Wells, vol. 18(4), pp. 59-61.
Zhao, 2007, "Efficiency Monitoring, Comparison Analysis and Optimization of Composite Perforators", Well logging technology, vol. 31(1), p. 66-71.
Zhang et al., 1986, "Preliminary studies on high energy gas fracture", Journal of Xi'an Petroleum Institute, vol. 1 (2).
Liu et al., 2006, "Investigation on a composite perforator with in-built secondary synergistic effect", Conference paper of the fifth annual conference of the perforating branch of the Professional Committee of well testing in the Chinese Petroleum Society.
Yao et al., 2006, "Experimental investigation on the effect of a sleeve like gunpowder on the penetration depth of composite perforator", Conference on new developments in perforation technology by the perforating branch of the Professional Committee of well logging in the Chinese Petroleum Society.
Feng et al., 1996, "Analysis of the characteristics of two gunpowder charges in multi-pulse composite perforator and the process of fracturing", Explosive Materials, vol. 75 (4), 130-133.
Zhao et al., 2005, "On powder Burning Characteristics of Various Perforators", Well logging technology, vol. 30 (1) , 44-46.
Wang et al., 2002, "The current status and trends in combined perforating-fracturing techniques", Explosive materials, vol. 31 (3), 30-34.
Sun et al., 2007 "Review of combined perforating techniques", Explosive materials, vol. 36 (5).

(56) References Cited

OTHER PUBLICATIONS

Feng et al., 2005, "Investigation on multi-pulse perforation techniques", Explosive materials, vol. 34 (1), 32-36.
Zhu, 1993, "Developments of perforators outside China", Explosive Materials, vol. 75(4).
Apr. 16, 2014 Office Action for U.S. Appl. No. 13/814,243.
Jul. 8, 2014 Office Action for U.S. Appl. No. 13/814,243.
Jun. 25, 2014 Office Action for U.S. Appl. No. 13/814,242.
Sep. 23, 2014 Office Action for U.S. Appl. No. 13/814,242.
Sep. 29, 2014 Office Action for U.S. Appl. No. 13/521,522.
Nov. 22, 2012 Office Action for CN 201010809790.5.
Sep. 27, 2012 Office Action for CN 200910218911.0.

* cited by examiner

STRUCTURE FOR GUNPOWDER CHARGE IN COMBINED FRACTURING PERFORATION DEVICE

This application is a Continuation-in-part of International Application PCT/CN2011/083112 filed Nov. 29, 2011, which claims priority of Chinese Application 201020684805.X, filed Dec. 29, 2010. This application is also a Continuation-in-part of U.S. application Ser. No. 13/521,522 filed Jan. 4, 2013, which is the National Stage of International Application PCT/CN2010/078601, filed Nov. 10, 2010 which claims priority of Chinese Application 200910218911.0, filed Nov. 11, 2009. The entire content of these applications are incorporated by reference into this application.

FIELD OF THE INVENTION

The present invention relates to the field of oil exploration and exploitation, particularly to a structure for gunpowder charge in combined fracturing perforation devices.

BACKGROUND OF THE INVENTION

In the field of exploration and exploitation of oil and gas wells, combined perforation technology is widely used in the well completion process as an effective method to increase productivity. However, as the techniques for exploitation of oil and gas wells become more developed, oil reservoirs having low permeability, ultra-low permeability, or oil reservoirs that are difficult to draw on are exploited one after another. Conventional combined perforation technologies do not have a good effect on increasing the productivity of these types of oil reservoirs due to the limited charge volume and the low energy. Chinese Patent CN20156803.8 disclosed a combined fracturing perforation device having two types of gunpowder mounted on the cylindrical charge frame, wherein the primary gunpowder mounted in the shells inside the charge frame is columnar in shape, and the secondary gunpowder mounted outside the charge frame is cylindrical in shape. The problems associated with this device are: firstly, when the cylindrical secondary gunpowder is being mounted, the retaining ring at one of the ends of the charge frame must be removed to mount the individual cylinders one by one. This is a complex process with low efficiency. Secondly, the cylindrical secondary gunpowder occupies a relatively large space during packaging and transportation such that they are inconvenient and expensive to store and transport. Thus, there is a need to improve the structure for gunpowder charge in combined fracturing perforation devices.

SUMMARY OF INVENTION

The technical solution to the aforesaid problem is to provide a structure for gunpowder charge in combined fracturing perforation devices that is convenient to mount and transport.

The present invention provides a structure for gunpowder charge for charging gunpowders with different burning rates in combined fracturing perforation devices. In one embodiment, the combined fracturing peroration device comprises a single perforator or a perforator made by joining of multiple perforators. The perforator has a perforating gun wherein a cylindrical charge frame is mounted. Multiple perforating charges for shaped charge perforation are mounted on said cylindrical charge frame.

In one embodiment, the structure for gunpowder charge in this invention comprises an inner gunpowder box and an outer gunpowder box. The inner gunpowder box containing primary gunpowder is mounted inside the cylindrical charge frame and placed between adjacent shaped perforating charges. The outer gunpowder box containing secondary gunpowder is mounted on the outer wall of the cylindrical charge frame. During perforation, the result of igniting the perforating charge with the detonating cord is to first cause the ignition of the primary gunpowder in the inner gunpowder box which then will ignite the secondary gunpowder in the outer gunpowder box on the outer wall of the charge frame. In one embodiment, the time difference between the pressure peaks of the primary gunpowder and the secondary gunpowder is 5-10 ms. As the time difference between the pressure peaks of the primary gunpowder and the secondary gunpowder leads to energy complementation, the duration of the effective pressure developed in the bore is extended; therefore, energy utilization is fully enhanced and the fissure length is elongated.

In one embodiment, the outer gunpowder box comprises one or two box units, wherein gunpowder is charged into an inner cavity of the box unit and the inner side of the box unit has a claw that is locked in a groove or an installation hole of the charge frame. The projected shape of the structure of the single box unit can be in shapes such as T shaped or rectangle. There are two methods to charge gunpowder into the box unit: (1) The gunpowder is casted in the box unit such that the box unit and gunpowder becomes a single entity and there is no further need for a box cover; (2) the gunpowder is charged into the box unit in the forms such as tablets, granules or pellets and in order to ensure the box unit and the perforation device are in a safe state free from leakage of gunpowder, the open end of the box unit has a box cover to prevent the different forms of gunpowder from falling out.

Examples of outer gunpowder box provided by the present invention include, but are not limited to, the following two forms at the discretion of the user.

In the first form, the outer gunpowder box comprises one box unit having three claws at the inner side of the box unit which are locked into the grooves in the charge frame. In one embodiment, two of the three claws are each at the edge of the two sides of the upper end of the box unit, and the other claw is at the center of the lower end of the box unit. In one embodiment, the claws are L-shaped.

Alternatively, the outer gunpowder box comprises two box units which are connected through a flexible belt. Each box unit has claws at the inner side of the box unit which can lock into the installation holes of the charge frame. In one embodiment, each of the box units has two claws at the inner side of the box unit separately positioned at the free end of the box unit. In one embodiment, the claws are V-shaped.

In one embodiment, the box unit of the outer gunpowder box is made of non-metallic materials such as high strength polyethylene of high heat resistance (e.g. a cross-linking agent is mixed with the polyethylene to enhance the strength of the connection between the molecular chains), polytetrafluoroethylene or polypropylene that is capable of withstanding temperature in the range of about 121° C. to 250° C.

Similarly, in one embodiment, the flexible belt of the outer gunpowder box is made of non-metallic materials such as high strength polyethylene of high heat resistance, polytetrafluoroethylene or polypropylene that is capable of withstanding temperature in the range of about 121° C. to 250° C. The flexible belt can also be made of soft metallic materials such as aluminum or magnesium.

In comparison with the prior art, the present invention has a simple structure. Since the box units for gunpowder charging (i.e., the outer gunpowder box) is connected to the charge frame through claws, the box units can be rapidly and conveniently mounted such that the assembling efficiency is significantly increased. With the use of one single outer gunpowder box or unfolding of the structures formed by connecting two single outer gunpowder boxes with a flexible belt during packaging, the packing density of the outer gunpowder boxes is increased and the costs for packaging, storage and transport are reduced.

Figure 1:
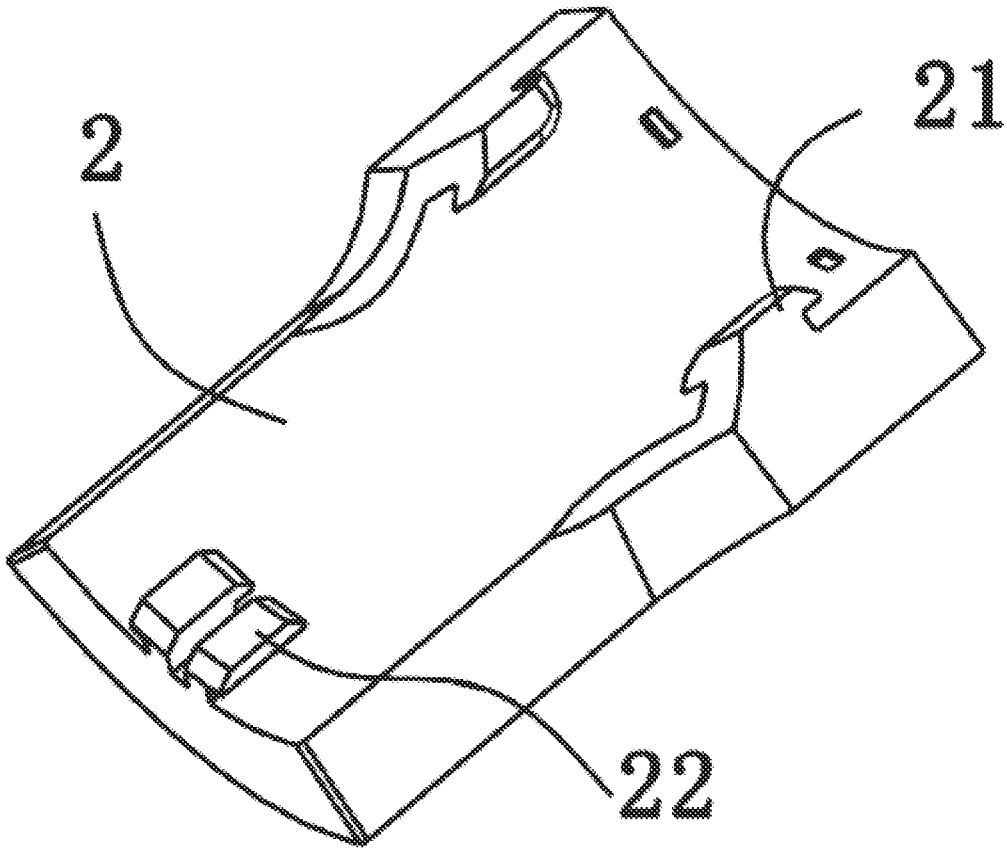
FIG. 1 shows a perspective view of the structure for gunpowder charge as described in Example 1.
Figure 2:
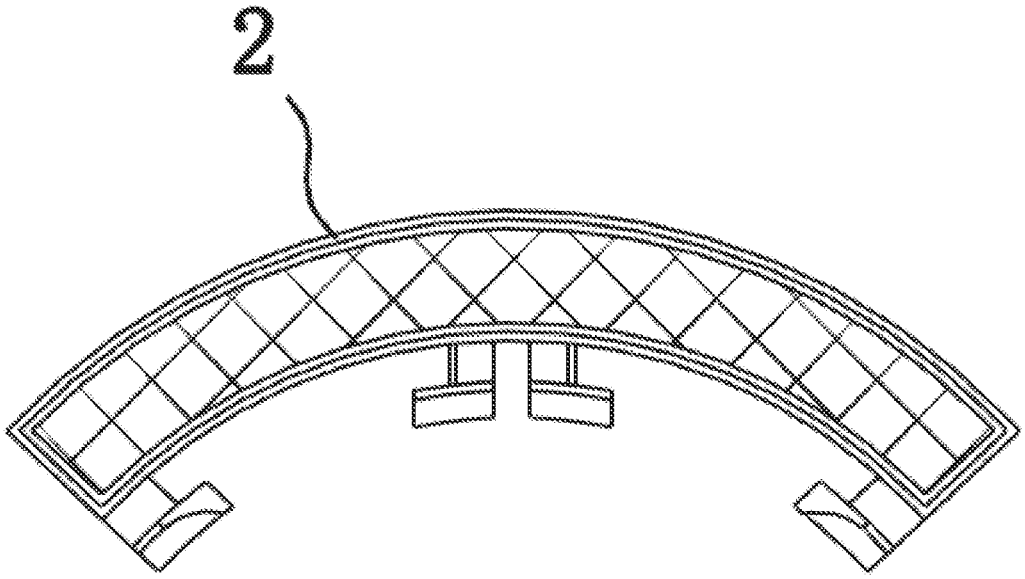
FIG. 2 shows a cross-sectional view of the structure shown in FIG. 1.
Figure 3:
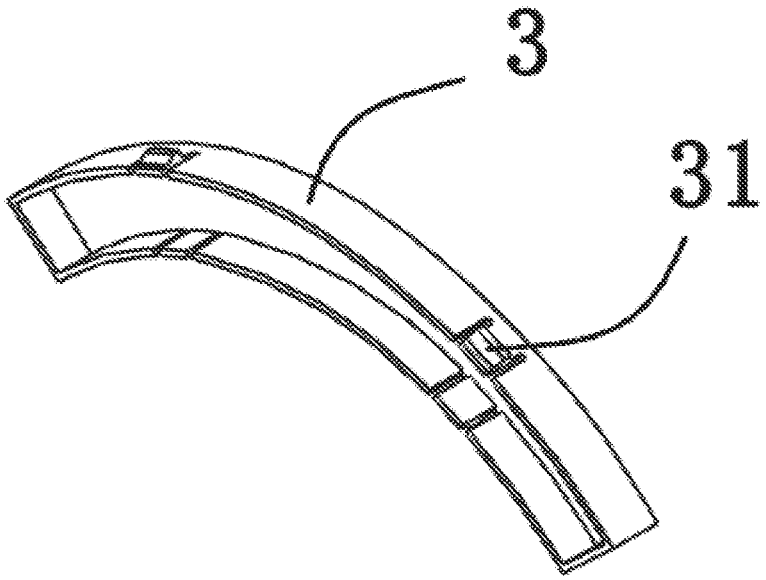
FIG. 3 shows a perspective view of the box cover of the outer gunpowder box of Example 1.
Figure 4:
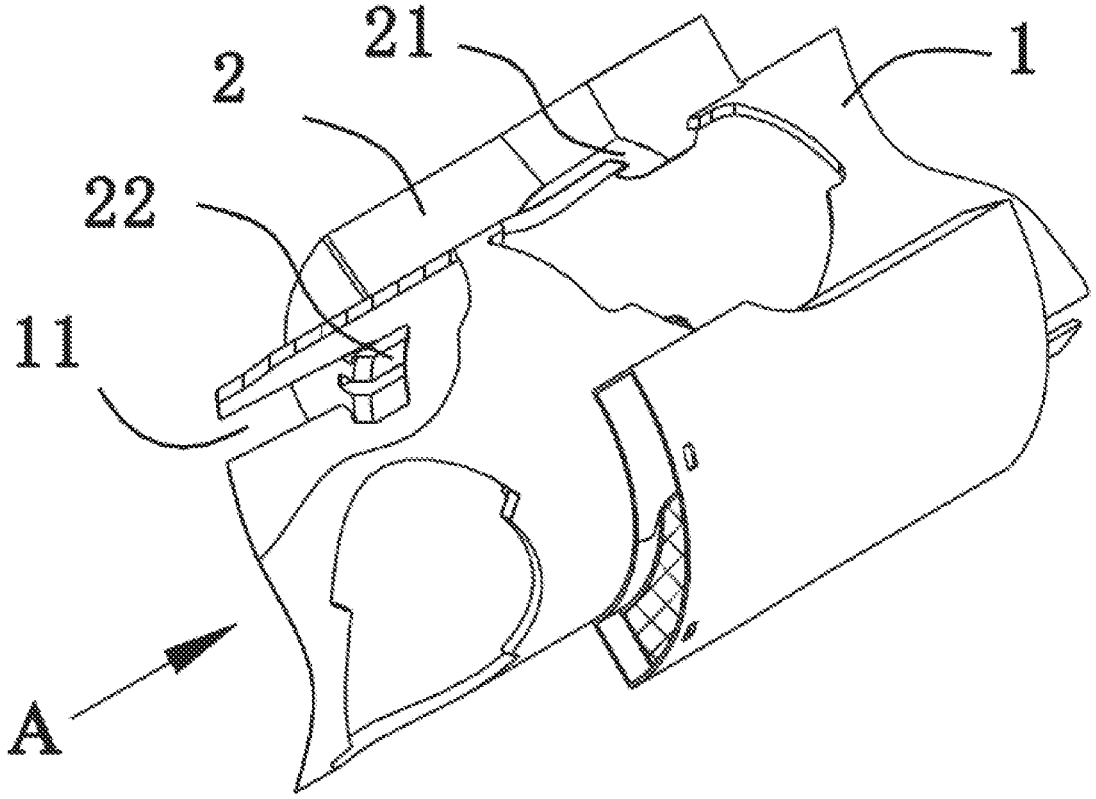
FIG. 4 shows a perspective view of the gunpowder charging box unit of Example 1 assembled with the charge frame.
Figure 5:
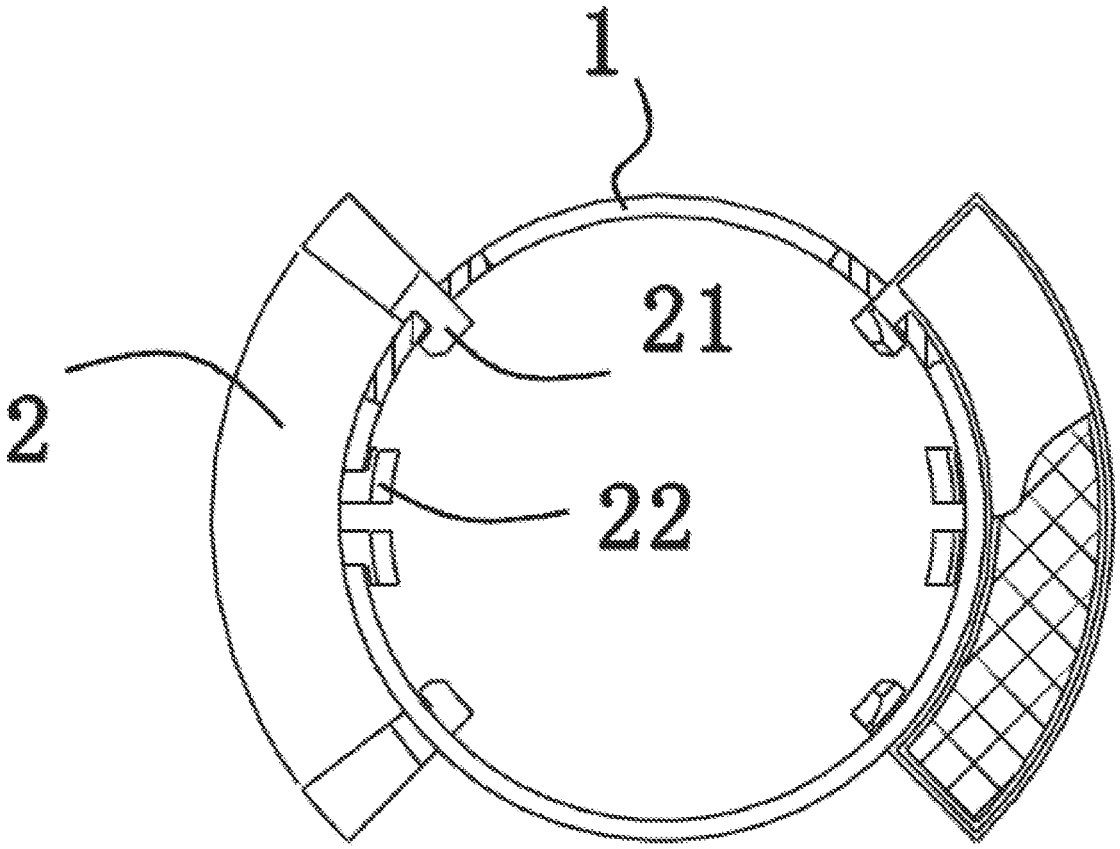
FIG. 5 shows the view from "A" direction of FIG. 4.

1: charge frame, 11: groove, 2: box unit of an outer gunpowder box with one box unit, 21-22: claws, 3: box cover, 31: wedge-shaped projections, 4: box unit of an outer gunpowder box that comprises two box units, 41: claw, 42: box cover, 5: flexible belt.

DETAILED DESCRIPTION OF THE INVENTION

In one embodiment, the present invention provides a structure for gunpowder charge for a combined fracturing perforation device, said structure for gunpowder charge comprises an inner gunpowder box located between adjacent perforating charges in the charge frame of said perforation device, and an outer gunpowder box attached to the outer wall of the charge frame, wherein said outer gunpowder box comprises one or two box units (2 or 4) with at least one claw at the inner side of said box unit, said claw can be locked into a groove or installation hole of the charge frame, and wherein said inner gunpowder box and said outer gunpowder box are charged with gunpowders of different burning rates.

In one embodiment, the projected shape of said box unit (2 or 4) is rectangular or T-shaped.

In one embodiment, said box unit (2 or 4) further comprises a box cover (3 or 42).

In one embodiment, said outer gunpowder box comprises one box unit 2 with three claws (21, 22) at the inner side of said box unit 2 and said three claws (21, 22) are locked into the groove 11 of the charge frame 1.

In another embodiment, two of said three claws 21 are each at the edge of the two sides of the upper end of said box unit 2, and the other claw 22 is at the center of the lower end of said box unit 2.

In yet another embodiment, said three claws are L-shaped.

In one embodiment, said outer gunpowder box comprises two box units 4 which are connected together through a flexible belt 5, and at least one claw 41 at the inner side of each of the box unit 4; wherein said claw 41 is locked in the installation hole of the charge frame 1.

In another embodiment, said claw 41 is positioned at the inner side of the free end of said box unit 4. In yet another embodiment, said claw 41 is V-shaped.

In one embodiment, said flexible belt 5 is made from high-temperature resistant metal or non-metallic materials. In one embodiment, said metal or non-metallic materials are temperature resistant in the range of about 121° C.~250° C. In another embodiment, said non-metallic material is high-strength polyethylene, polytetrafluoroethylene, or polypropylene. In yet another embodiment, said flexible belt (5) is made from aluminum or magnesium.

In one embodiment, said box unit is made from high-temperature resistant non-metallic materials. In one embodiment, said non-metallic materials are temperature resistant in the range of about 121° C.~250° C. In another embodiment, said non-metallic material is high-strength polyethylene, polytetrafluoroethylene, or polypropylene.

In one embodiment, said claw is locked into the groove or installation hole of the charge frame through a one-step process. For example, said one-step process is a sliding process.

The embodiments of the present invention will be described in details with reference to the accompanying drawings.

EXAMPLE 1

In one embodiment, an outer gunpowder box comprises a single box unit (FIGS. 1-5). The projection of the box unit 2 is T-shaped and is bent to a circular-arc shape so that the inner side of the box unit matches the outer cylindrical surface of the cylindrical charge frame 1. In one embodiment, the inner side of the box unit 2 has three claws 21, 22, wherein the two claws 21 are at the two edges of the two sides of the upper end of the box unit 2 while claw 22 is at the center of the lower end of the box unit 2. All three claws are L-shaped, and lock into the groove 11 in the charge frame 1 (See FIG. 4). The big end of the box unit 2 is mounted with box cover 3. The box cover 3 has four wedge-shaped projections 31 which form a wedge-shaped buckle assembly with the buckle hole on the box unit. During mounting, the inner side of the box unit is abutted to the outer surface of the charge frame to allow the claws to align with the groove of the charge frame and to slide along the groove, so that the outer gunpowder box can be mounted and hung on the charge frame. After the perforating charges are mounted, the perforating charges will prevent the gunpowder boxes from being displaced from their position.

In this example, box unit 2 is made of high strength polyethylene of high heat resistance (i.e. a cross-linking agent is mixed with the polyethylene to enhance the strength of the connection between the molecular chains) withstanding temperatures up to 163° C.

EXAMPLE 2

Figure 6:
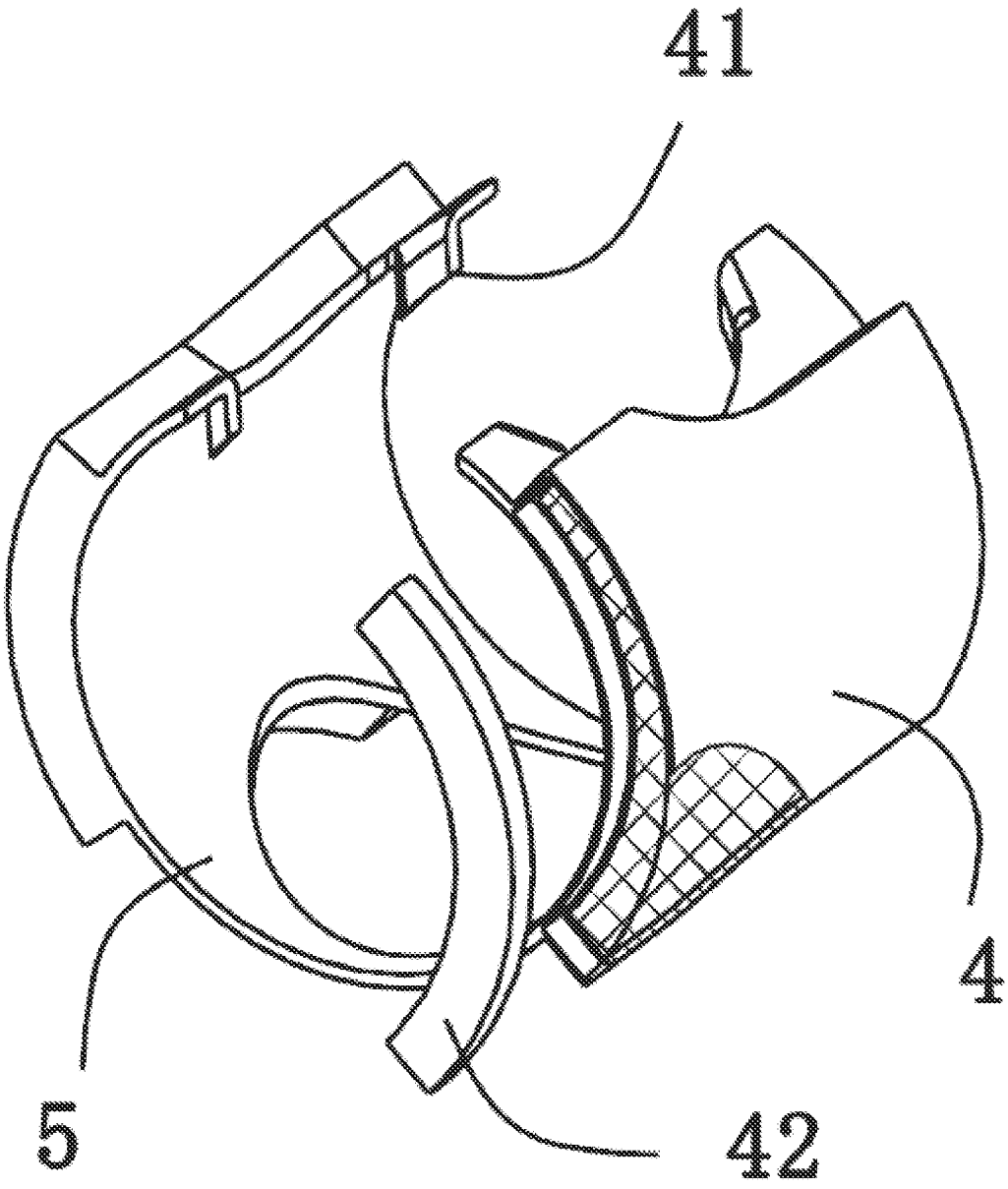
FIG. 6 shows a perspective view of the structure as described in Example 2.
Figure 7:
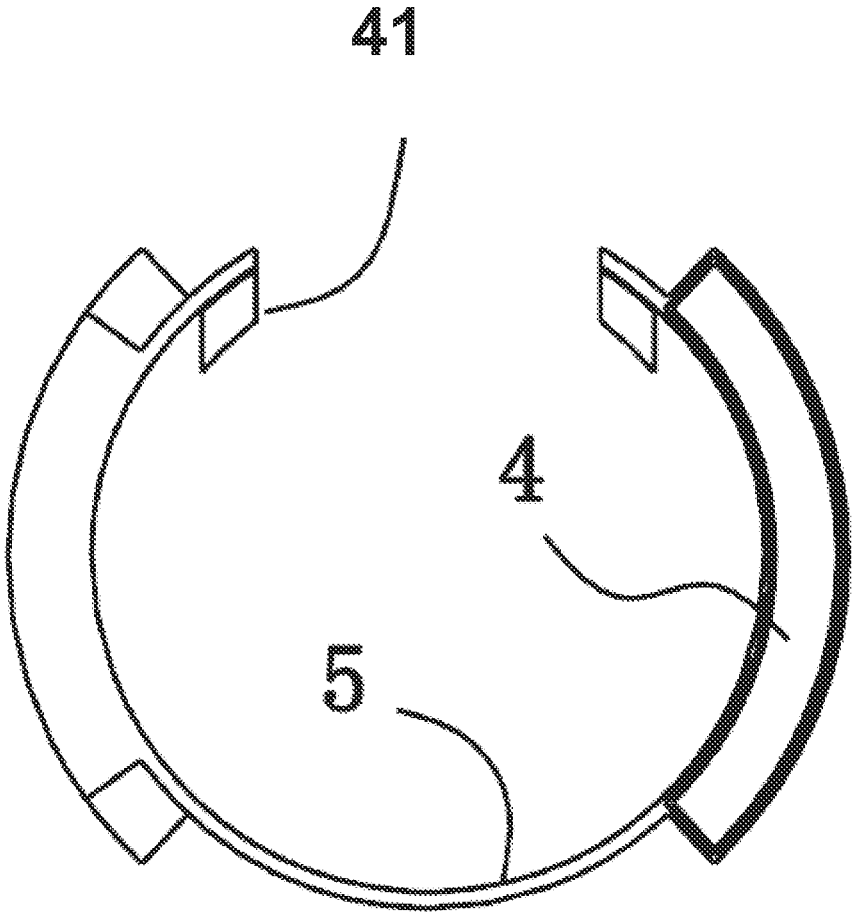
FIG. 7 shows the axial view of the structure as described in Example 2.
Figure 8:
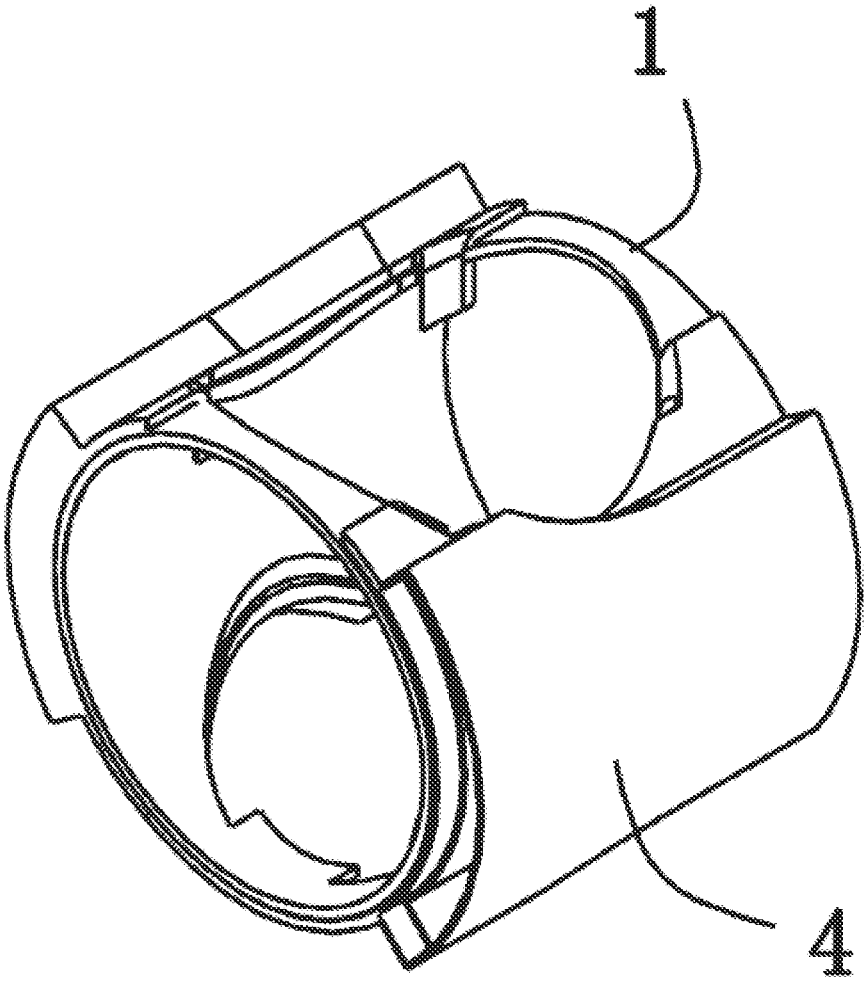
FIG. 8 shows a perspective view of the gunpowder charging box unit of Example 2 assembled with the charge frame Legend of the figures.

In another embodiment, the outer gunpowder box comprises two T-shaped box units 4 connected together (FIGS. 6-8). The larger ends of the two T-shaped box units 4 are directed to opposite directions and the two T-shaped box body units are connected on one side through a flexible belt 5 made from polymeric material with the other side being free. The cross-section is C-shaped. The free end of each of the box unit has two claws 41 which are locked in the installation holes of the charge frame. The larger end of the box unit 4 is mounted with box cover 42. The structure of the box cover 42 is the same as that of Example 1. For this kind of structure, it is preferable to use V-shaped claws. The flexible belt 5 can bend and unfold, thereby reduces the space occupied in packaging.

During mounting, the four claws are locked into the holes of the charge frame 1, as shown in FIG. 8.

In this example, the box unit 4 is made of high strength polyethylene of high heat resistance withstanding temperature up to 200° C.; the flexible belt 5 is made of the same polyethylene as box unit 4 withstanding temperature up to 200° C.

What is claimed is:

1. A structure for gunpowder charge for a combined fracturing perforation device, said structure for gunpowder charge comprises an inner gunpowder box located between adjacent perforating charges in the charge frame of said perforation device, and an outer gunpowder box attached to the outer wall of the charge frame, wherein said outer gunpowder box comprises one or two box units, each box unit comprises an inner side facing the outer wall of the charge frame, wherein said inner side comprises at least one claw, said claw can be locked into a groove or installation hole of the charge frame, and wherein said inner gunpowder box and said outer gunpowder box are charged with gunpowders of different burning rates.

2. The structure for gunpowder charge of claim 1, wherein said box unit has a rectangular or T-shaped projected shape.

3. The structure for gunpowder charge of claim 1, wherein said box unit further comprises a box cover at an open end of said box unit.

4. The structure for gunpowder charge of claim 1, wherein said outer gunpowder box comprises one box unit (2) with three claws (21, 22) at the inner side of said box unit (2) and said three claws (21, 22) are locked into the groove (11) of the charge frame (1).

5. The structure for gunpowder charge of claim 4, wherein said box unit (2) comprises an upper end and a lower end, said upper end having two sides each comprising an edge, wherein two of said three claws (21) are each at the edge of the two sides of the upper end of said box unit (2), and the other claw (22) is at the center of the lower end of said box unit (2).

6. The structure for gunpowder charge of claim 4, wherein said three claws are L-shaped.

7. The structure for gunpowder charge of claim 1, wherein said outer gunpowder box comprises two box units (4) which are connected together through a flexible belt (5), and at least one claw (41) at the inner side of each of the box unit (4); wherein said claw (41) is locked in the installation hole of the charge frame (1).

8. The structure for gunpowder charge of claim 7, wherein said claw (41) is positioned at the inner side of a free end of said box unit (4).

9. The structure for gunpowder charge of claim 7, wherein said claw (41) is V-shaped.

10. The structure for gunpowder charge of claim 7, wherein said flexible belt (5) is made from high-temperature resistant metal or non-metallic materials.

11. The structure for gunpowder charge of claim 10, wherein said metal or non-metallic materials are temperature resistant in the range of about 121° C.~250° C.

12. The structure for gunpowder charge of claim 10, wherein said non-metallic material is high-strength polyethylene, polytetrafluoroethylene, or polypropylene.

13. The structure for gunpowder charge of claim 10, wherein said high temperature resistant metal is aluminum or magnesium.

14. The structure for gunpowder charge of claim 1, wherein said box unit is made from high-temperature resistant non-metallic materials.

15. The structure for gunpowder charge of claim 14, wherein said non-metallic materials are temperature resistant in the range of about 121° C.~250° C.

16. The structure for gunpowder charge of claim 14, wherein said non-metallic material is high-strength polyethylene, polytetrafluoroethylene, or polypropylene.

17. The structure for gunpowder charge of claim 1, wherein said claw is locked into the groove or installation hole of the charge frame through a one-step process.

18. The structure for gunpowder charge of claim 17, wherein said one-step process is a sliding process.

* * * * *